US005944621A

United States Patent [19]

Tsujinaka et al.

[11] Patent Number: 5,944,621

[45] Date of Patent: Aug. 31, 1999

[54] HOLLOW GOLF BALL

[75] Inventors: Hiroyuki Tsujinaka, deceased, late of Kobe; Minoru Tsujinaka, legal representative; Kinuko Tsujinaka, legal representative, both of Kadoma; Kazuo Hochi, Amagasaki; Masaya Tsunoda, Akashi; Keiji Moriyama, Shirakawa; Kiyoto Maruoka, Kobe, all of Japan

[73] Assignee: Sumitomo Rubber Industries, Ltd., Hyogo-ken, Japan

[21] Appl. No.: 08/961,068

[22] Filed: Oct. 30, 1997

[30] Foreign Application Priority Data

Oct. 30, 1996 [JP] Japan ..... 8-288099

[51] Int. Cl.[6] ..... A63B 37/06

[52] U.S. Cl. ..... 473/369; 473/370

[58] Field of Search ..... 473/369, 375, 473/367, 368, 370

[56] References Cited

U.S. PATENT DOCUMENTS 703,239 6/1902 Davis ..... 473/369
707,263 8/1902 Saunders ..... 473/375 X
5,439,227 8/1995 Egashira et al. ..... 473/374 X

FOREIGN PATENT DOCUMENTS 828774 2/1960 United Kingdom .
WO974 4098A1 11/1997 WIPO .

*Primary Examiner*—George J. Marlo
*Attorney, Agent, or Firm*—Birch, Stewart, Kolasch & Birch, LLP

[57] ABSTRACT

The present invention provides a hollow golf ball having a spherical cavity in the center, which exhibits excellent durability and less impact strength to result in excellent shot feel without degrading flight performance, and the production of the same. The hollow golf ball includes: (a) hollow center formed from a material selected from the group consisting of rubber, thermoplastic resin and a mixture thereof, the hollow center having a hollow portion with a diameter of 5 to 30 mm; (b) at least one core rubber layer, formed on said hollow center, the core rubber layer being obtained by vulcanizing a rubber composition which comprises a base rubber, a metal salt of an unsaturated carboxylic acid, an organic peroxide and filler; and (c) a cover formed on said core rubber layer.

13 Claims, 3 Drawing Sheets

HOLLOW GOLF BALL

FIELD OF THE INVENTION

The present invention relates to a hollow golf ball and a process for producing the same. More particularly, it relates to a hollow golf ball having a spherical cavity in the center, which exhibits excellent durability and less impact strength turning to excellent shot feel without degrading flight performance, and the production of the same.

BACKGROUND OF THE INVENTION

Hitherto, there have been two types of golf balls. One is a solid golf ball, such as a two piece solid golf ball which is composed of a core formed by rubber material and a cover formed from thermoplastic resin (e.g. ionomer resin), surrounding the core. The other is a thread wound golf ball which is composed of a solid or liquid center, a thread layer formed by winding thread rubber on the center and a cover with 1 to 2 mm thick formed from ionomer resin or balata. The two piece solid golf ball, when compared with the thread wound golf ball, has superior flight performance, because it shows higher initial velocity at the time of hitting and therefore obtains longer flight distance. The two piece solid golf ball also shows superior durability to the thread wound golf ball. Accordingly, the two piece solid golf ball has been exclusively used by many golfers, especially amateur golfers. However, the two piece solid golf ball has a defect in that shot feel being hard when hitting.

In order to improve the defect of the solid golf balls, the present inventors have proposed that the core of the solid golf balls is made hollow so that the inertia moment of the golf ball increases to improve shot feel when hitting without injuring the excellent flight performance of the solid golf ball.

The reason why a hollow golf ball attains the above improvement is as follow. The continuance of spin of the two piece solid golf ball is governed not only by the configuration of dimples but also by the moment of inertia of the golf ball. It is believed that the larger the moment of inertia, the more difficult the spin is applied on the golf ball but the more lasting the spin once spin is applied on the golf ball. This means that, if a golf ball has larger moment of inertia, the golf ball, when hitting with a driver, does not receive spin so much and therefore prolongs its flight distance without blowing up by the air. The golf ball generally receives lifting power during flight, but the lifting power is controlled by the amount of spin. The more the spin the stronger the lifting power. Between the hitting point by a driver and the highest point of the golf ball, less spin amount is better to prolong flight distance, because the lifting power would be low if the amount of spin is low and therefore the power of the component returning the ball in the lifting power would be low. After the ball reaches the highest point, a larger spin amount or larger continuance of spin is better to prolong flight distance, because the lifting power would be highly maintained if the amount of spin is highly maintained and therefore the power of the component carrying the ball forward in the lifting power would be high. Accordingly, the larger the moment of inertia of the golf ball, the more the flight distance is prolonged. In addition, when it is used at approach shot, the larger the moment of inertia, the easier the golf ball is controlled, because the back spin once applied on the golf ball would be continuously maintained and the ball would stop on the green to back spin. In view of shot feel, it is believed that the core is made soft and the shot feel is softened, but if the core is made hollow, this leads to the ball being soft.

However, making solid cores hollow leads to other problems in producing the golf balls. For example, the rubber composition for the core is prepared and subjected to vulcanization either by press molding using a mold shown in FIG. 2 in which a core mold 11 containing a core 10 is used, or injection molding, to form a semi-spherical shell 12. Two of the semi-spherical shells are adhered with each other by rubber cement to form a core. The golf ball using the thus obtained core has poor durability, because the core is broken at the surface of the adhering area as the impact force is very high when the ball is hit by a golf club. As another example, a rubber composition for core is prepared and subjected to semi-vulcanization either by press molding using a mold shown in FIG. 2 in which a core mold 11 containing a core 10 is used, or injection molding, to form a semi-vulcanized semi-spherical shell 12. Two of the semi-vulcanized semi-spherical shells are contacted with each other and then vulcanized using a mold shown in FIG. 3 to form a core. In the step of the second vulcanization, the core is deformed by expansion of rubber and the hollow portion is not always complete sphere, thus forming distribution in core thickness. This creates the difference in shot feel and flight performance depending on the portion to be hit by a golf club.

OBJECTS OF THE INVENTION

An object of the present invention is to provide a hollow golf ball having a spherical cavity in the center, which exhibits excellent shot feel without degrading the flight performance of the solid golf balls, and a production thereof.

The above object is accomplished by introducing a hollow center having a cavity therein, which is encapsulated in a core and then covered with a cover. The hollow portion present in the center keeps the shape of a complete sphere and exhibits excellent shot feel and excellent durability without deteriorating the flight performance of the solid golf balls.

This object as well as other objects and advantages of the present invention will become apparent to those skilled in the art from the following description with reference to the accompanying drawing.

SUMMARY OF THE INVENTION

The present invention provides a hollow golf bill comprising:

(a) a hollow center formed from a material selected from the group consisting of rubber, thermoplastic resin and a mixture thereof, (b) at least one core rubber layer, formed on the hollow center, and (c) a cover formed on the core rubber layer.

The present invention also provides a process for producing a hollow golf ball comprising the following steps:

(i) a hollow center is formed from a material selected from the group consisting of rubber, thermoplastic resin and a mixture thereof, (ii) a rubber composition for core is covered on the hollow center and vulcanized to form a vulcanized rubber layer and optionally the same process is repeated, thus obtaining a hollow core, and (iii) the hollow core is covered with a cover.

DETAILED DESCRIPTION OF THE INVENTION

According to the present invention, a spherical hollow center is firstly prepared from a material selected from the group consisting of rubber, thermoplastic resin and a mixture thereof, and then surrounded with a rubber composition for core, followed by vulcanizing. The hollow portion, therefore, does not deform when forming the core layer. In case where a rubber composition for core is prepared and subjected to semi-vulcanization either by press molding using a mold shown in FIG. 2 in which a core mold 11 containing a core 10 is used, or injection molding, to form a semi-vulcanized semi-spherical shell 12, two of which are contacted with each other and then vulcanized using a mold shown in FIG. 3 to form a core, the wall thickness of the center is made thin in comparison with the case where the core is directly molded without the center. Therefore the expansion of rubber is kept very small when vulcanizing and the hollow portion is not deformed and kept complete sphere.

Figure 1:
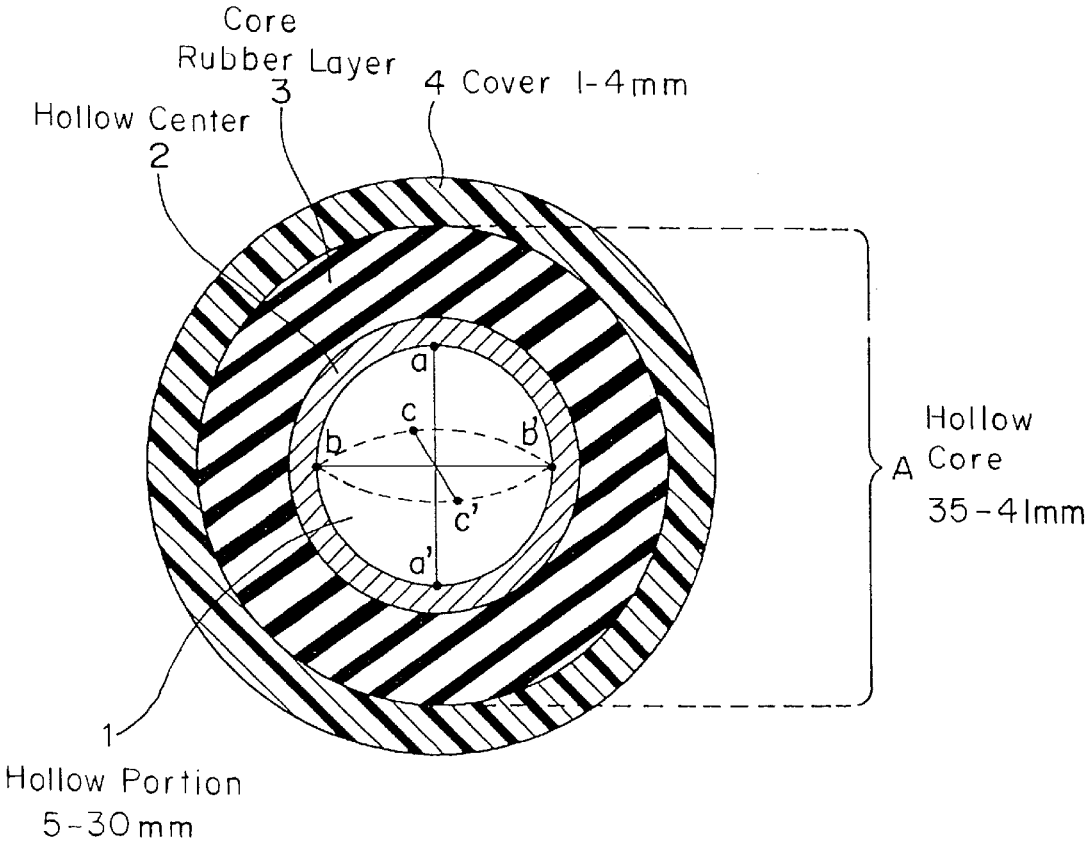
FIG. 1 is a schematic cross section illustrating one embodiment of the golf ball of the present invention.

The construction of the hollow golf ball of the present invention is explained with reference to FIG. 1. FIG. 1 shows a schematic cross section illustrating one embodiment of the golf ball of the present invention. As shown in FIG. 1, a core rubber layer 3 is formed on a spherical hollow center 2, of which the center 3 and the core rubber layer 2 constitute a core (hollow core) A. On the hollow core A, a cover 4 is covered.

The hollow center is formed from a material selected from the group consisting of rubber, thermoplastic resin and a mixture thereof. When the hollow center is formed from rubber, the center is prepared by a method conventionally known to art for producing a hollow rubber ball. For example, a rubber composition for the hollow center is prepared and semi-vulcanized in a mold for half-spherical shell, followed by subjecting two of the shells into complete vulcanization to form a hollow center. By the term "semi-vulcanization" used herein is meant that vulcanization of rubber is not completely conducted and stops before the completion of crosslinking reaction. The rubber article thus semi-vulcanized, if again heated to a vulcanizing temperature, can proceed the crosslinking reaction to complete. The "semi-vulcanization" is conducted at a vulcanizing temperature for half a period of complete vulcanization, for example at 150° C. for about 15 minutes in case where the complete vulcanization is conducted at 150° C. for about 30 minutes.

Figure 2:
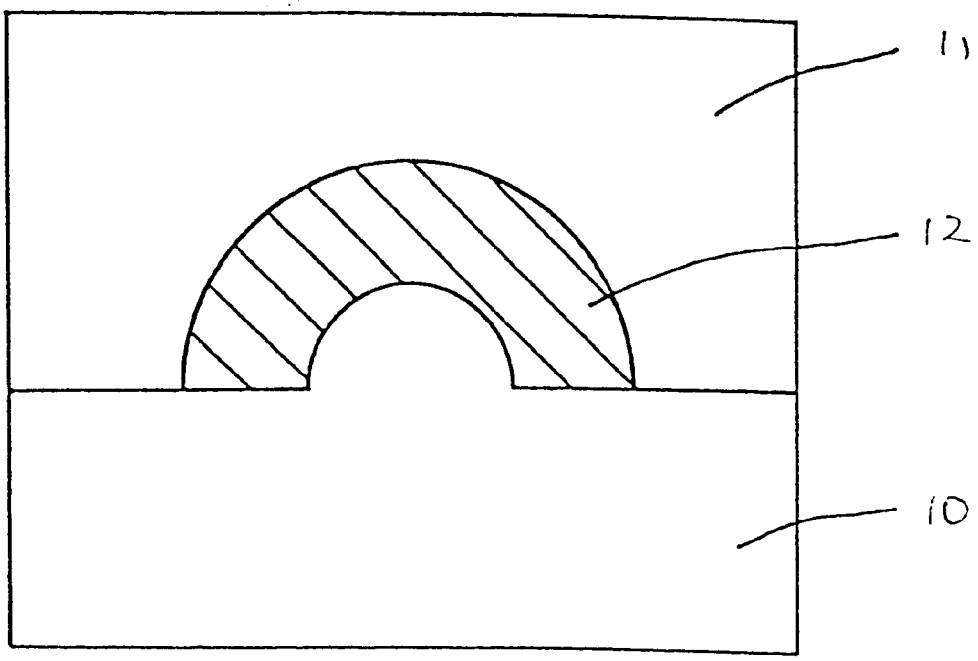
FIG. 2 is a schematic cross-section of the core mold for producing a semi-spherical core shell.

In the present invention, since the rubber composition for the hollow center is preferably complete-vulcanized at a temperature of 150 to 170° C. for 10 to 30 minutes, the semi-vulcanization of the spherical shell stops at a middle point of the complete vulcanizing period. A method for molding into the half spherical shell is known to the art, for example a method wherein a core mold having the same shape as the hollow portion is employed as shown in FIG. 2. It may be conducted by injection molding. The half spherical shell does not always have an exact half shape of the hollow center, but the exact half of the hollow center is preferable in view of production efficiency, because the mold can be one type and the molded shell only has one shape.

Two of the spherical shells thus semi-vulcanized are contacted with each other so as to form a sphere and then subjected to the completion of vulcanization to obtain a hollow center. When the half shells are contacted, the contacting area of the shell may be coated with an organic solvent to enhance the adhesivity therebetween.

The rubber composition for the hollow center is composed of a rubber, a vulcanizing agent, a filler and the like. Examples of the rubber are natural rubber, polybutadiene, cis-isoprene rubber and a mixture thereof. The vulcanizing agent may be sulfur when sulfur vulcanization is conducted. When peroxide vulcanization is conducted, the vulcanizing agent can be a combination of an organic peroxide (such as dicumyl peroxide) and a vulcanization auxiliary (such as metal salt of $\alpha,\beta$-unsaturated carboxylic acid, particularly a divalent metal salt of acrylic acid or methacrylic acid).

When the hollow center is formed from rubber as mentioned above, it is preferred that the hollow center is pressured by gas (such as air or nitrogen gas) to a pressure more than atmospheric pressure, for example 1 to 2 atmospheric pressure, in order to enhance the sphericity of the hollow portion at the time when the core rubber layer 3 is vulcanized or molded. The gas is encapsulated by a well-known method, such as a method wherein gas is injected into a hollow center by an injection syringe and then sealed. In addition, a gas developing agent is put into the inside of the hollow center when producing the hollow center.

When the hollow center is formed from the thermoplastic resin, a half-spherical shell is formed by a conventional method, such as injection molding, and then two of the shell are adhered with each other to form a sphere.

The thermoplastic resin not only includes general thermoplastic resin injection-moldable but also includes a thermoplastic elastomer generally composed of soft-segment and hard-segment. The thermoplastic elastomer means a polymer material which exhibits vulcanized rubber-like properties at ambient temperature (room temperature) and, at an elevated temeprature, is plastized and moldable by a plastic molding machine. The theremoplastic elastomer is generally classified based on the type of the hard-segment, for example if the hard-segment is formed from polystyrene, it is called "polystyrene thermoplastic elastomer" in which the soft-segment is butadiene rubber or isoprene rubber. All the thermoplastic elastomers are known to the art and their combination of soft-segment and hard-segment is also art-known. A mixture of the thermoplastic resin and the thermoplastic elastomer can be employed. The thermoplastic resin has a melting point of not less than 150° C., preferably not less than 160° C., more preferably not less than 170° C. The upper limit of the melting point is not specified, but generally not more than 230° C. The present invention employs a thermoplastic resin generally having relatively high melting point, because the hollow center endures the temperature for vulcanizing or molding the core rubber on the hollow center and does not deform. Typical examples of the thermoplastic resins are polyethylene, polypropylene, polystyrene, polyvinyl chloride, poly(methyl methacrylate), polyacethal, polyamide, polyoxymethylene, polycarbonate, polyester, polyphenylene oxide, polysulfone, polyimide, a mixture thereof and the like. Examples of the thermoplastic elastomers are polyester thermoplastic elastomer, polyurethane thermoplastic elastomer, polystyrene thermoplastic elastomer, polyamide thermoplastic elastomer, a mixture thereof and the like. For imparting high rebound characteristics to golf ball, the polyester thermoplastic elastomer and polyurethane thermoplastic elastomer are preferred. Optionally, the thermoplastic resin may contain filler for controlling specific gravity, rubber particles for providing softness, crosslinking agent for the rubber particles and the like. The thermoplastic resin including the thermoplastic elastomer preferably has a Shore D hardness of 30 to 80°. Shore D of less than 30° reduces the rebound characteristics and that of more than 80° reduces shot feel.

The size of the hollow portion of the hollow center is not limited, but preferably has a diameter of 5 to 30 mm. If it is larger than 30 mm, the resulting golf ball has a large hollow and largely deforms when hitting by a club, resulting in large energy loss and poor rebound characteristics. If the hollow size is larger than 30 mm, a large amount of filler has to be formulated for adjusting the specific gravity of the golf ball, which leads to poor rebound characteristics. Thus, the hollow size is preferably not more than 25 mm. If the hollow portion is less than 5 mm, the technical effects brought about by the presence of the hollow, such as enhancement of moment of inertia or good shot feel, are not obtained. Accordingly, the hollow preferably has a diameter of not less than 10 mm.

It is preferred that the hollow center has a wall thickness of 0.1 to 12.5 mm. If the wall thickness is less than 0.1 mm, the center is easily deformed, especially in the process of forming the core rubber layer on the hollow center. More preferably, the hollow center has a wall thickness of not less than 0.5 mm, particularly not less than 1.0 mm. If the hollow center has a wall thickness of more than 12.5 mm, in case where the hollow center is formed from thermoplastic resin, the golf ball does not show good shot feel. In case where the hollow center is formed from rubber, the rubber largely expands when vulcanizing the hollow center and the hollow center would deform and become non-spherical shape. The center, thus, preferably has a wall thickness of not more than 6.0 mm, more preferably not more than 4.0 mm.

The core containing the hollow center preferably has a diameter of 35 to 41 mm, more preferably 36 to 39 mm, to ensure the thickness of the cover layer.

The core preferably has a wall thickness (a total of the wall thickness of the hollow center and the thickness of the core rubber layer) of 2.5 mm to 18 mm. If the core wall thickness is less than 2.5 mm, the cover layer is too thick or the hollow portion is too large. If the cover layer is too thick, shot feel is lowered. If the hollow portion is too large, rebound characteristics are degraded. The core wall thickness, thus, more preferably is not less than 3 mm, particularly not less than 7 mm. If the core wall thickness is more than 18 mm, the hollow portion is too small or the cover layer is too thin. If the hollow portion is too small, the technical effects obtained by the presence of the hollow, such as enhancement of inertia moment or good shot feel, are not obtained. If the cover layer is too thin, the durability of the golf ball is poor. The core wall thickness, thus, more preferably is not more than 15 mm.

The core rubber layer preferably has a thickness of 5 to 16 mm. If the core rubber thickness is less than 5 mm, the shot feel obtained from the presence of the core rubber is lowered. If the core rubber thickness is more than 16 mm, the hollow portion is too small or the cover thickness is too thin. If the hollow portion is too small, the technical effects obtained by the presence of the hollow, such as enhancement of inertia moment or good shot feel, are not obtained. If the cover layer is too thin, the durability of the golf ball is poor.

The core rubber layer (3) of the present invention are basically obtained by vulcanizing a rubber composition used as the core of the solid golf ball. The rubber composition generally contains a base rubber, a metal salt of an unsaturated carboxylic acid, an organic peroxide, a filler and the like. The base rubber includes natural rubber and/or a synthetic rubber which has been used in the solid golf ball. Examples of the synthetic rubbers are polybutadiene rubber, polyisoprene rubber, styrene-butadiene rubber, ethylene-propylene-diene rubber (EPDM) and the like. Particularly, a high-cis polybutadiene rubber having cis-1,4-bond of at least 40%, preferably at least 80% is preferred. The term "base rubber" generally means rubber components which are mainly contained in rubber component of the rubber composition and which predominantly shows the performance of the rubber.

The metal salt of the unsaturated carboxylic acid acts as co-crosslinking agent, and examples thereof include monovalent or divalent metal salt (e.g. sodium, potassium, zinc, magnesium salt, etc.) of an α,β-unsaturated carboxylic acid having 3 to 8 carbon atoms (e.g. acrylic acid, methacrylic acid, etc.). Among them, zinc acrylate which imparts high rebound performance is preferred. It is preferred that an amount of the metal salt blended is from 25 to 55 parts by weight, based on 100 parts by weight of the base rubber. When the amount is larger than 55 parts by weight, shot feel is poor. On the other hand, when the amount is smaller than 25 parts by weight, rebound characteristics are poor and flight distance is lowered.

The organic peroxide acts as crosslinking agent or curing agent, and examples thereof include dicumyl peroxide or t-butyl peroxide. Among them, dicumyl peroxide is preferred. It is preferred that an amount of the organic peroxide is from 0.5 to 3.0 parts by weight, based on 100 parts by weight of the base rubber. When the amount is less than 0.5 part by weight, the core rubber layer is too soft and therefore rebound characteristics are poor and flight distance is lowered. On the other hand, when the amount exceeds 3.0 parts by weight, the core rubber layer is too hard and shot feel is poor.

The filler may be any one which is generally blended in the core of the golf ball, and examples thereof include an inorganic salt (e.g. zinc oxide, barium sulfate, calcium carbonate, etc.), metal powder having a high specific gravity (e.g. tungsten powder, molybdenum powder, etc.) and a mixture thereof. Since the hollow core employed in the present invention weighs lighter than a conventional solid core, it is preferred that a combination of the inorganic salt ad the metal powder having a high specific gravity is used. An amount of the filler preferably is within the range of 10 to 120 parts by weight based on 100 parts by weight of the base rubber. Amounts of less than 10 parts by weight do not exhibit the technical effects of the filler and those of more than 120 parts) by weight reduces rebound characteristics.

Another component which can generally be used in the production of the core of the solid golf ball, such as antioxidants, peptizing agents, etc. may be added to the rubber composition of the core rubber layer of the present invention.

The hollow core A of the present invention can be obtained by semi-vulcanizing and molding a rubber composition of the core rubber layer to form a semi-vulcanized rubber shell having a concave equal to the hollow center 2 and then encapsulating the hollow center 2 with two of the semi-vulcanized rubber shells, followed by complete vulcanizing. The term "semi-vulcanization" has the same meaning as explained for the hollow center, but it is preferred that the vulcanizing period reduces to about 1/10, in order to enhance adhesive properties with the hollow center.

On the hollow core A, the cover 4 is formed. The cover can be formed from the material which has been used for a cover of golf balls, such as ionomer resin or balata. The ionomer resin or balata may be mixed with a small amount of another resin. The cover may also contain colorant, filler or additive which has been used for a cover of golf balls. the colorant may preferably be titanium dioxide and the filler may preferably be barium sulfate. Examples of the additives are ultra-violet absorber, light stabilizer, fluorescent material, fluorescent brightener and the like. An amount of the colorant, filler and additive is not limited as long as the properties of the cover are not degraded. An amount of the colorant is preferably within the range of 0.1 to 0.5 parts by weight.

The cover can be formed by a method which has been used for forming a cover of golf balls, such as injection molding and press molding. When the cover is formed, many concaves, called "dimples", are formed on the surface of the cover. The cover may have a thickness of 1 to 4 mm. If the cover has a thickness of less than 1 mm, the cover does not have enough strength and the golf ball lacks durability. If the cover has a thickness of more than 4 mm, shot feel is poor. In order to enhance appearance and value as commercial products, the golf ball of the present invention is coated with paint and then put into market. The cover may be constituted from two or more layers.

According to the present invention, the golf ball has a spherical hole in the center and exhibits excellent durability and excellent shot feel without degrading flight performance.

EXAMPLES

The following Examples and Comparative Examples further illustrate the present invention in detail but are not to be construed to limit the scope thereof.

Preparation of Hollow Center I to IV

Hollow center I: The rubber composition A shown in Table 1 was employed and semi-vulcanized and molded in a mold shown in FIG. 2 at 155° C. for 15 minutes to form a semi-vulcanized half spherical rubber shell having a rubber thickness of 2 mm and a hollow diameter of 20 mm. Two of the half spherical rubber shells were preliminary adhered using an acetone solution of the rubber composition A with each other and put in a mold shown in FIG. 3, followed by vulcanizing at 155° C. for 20 minutes to form a hollow rubber center having a diameter of 24 mm. Into the hollow center, air was injected by an injection syringe and at an inside pressure of more than atmospheric pressure, the hollow center was sealed with a rubber sheet having an adhesive coating on one side. The rubber sheet was prepared from the same rubber composition as the hollow center.

Hollow center II: A thermoplastic polyacethal homopolymer resin available from Asahi Chemical Industrial Co., Ltd. as Tenac 7010 was injection-molded into a mold as shown in FIG. 2 at 250° C. to form a spherical half shell having a thickness of 1 mm and a hollow diameter of 20 mm. Two of the half shells were adhered by an adhesive agent with each other to form a hollow center II having a diameter of 22 mm.

Hollow center III: A hollow center III was prepared as generally described in the preparation of the hollow center I, with the exception that the injection of air by the injection syringe was not conducted. The resulting hollow center has a wall thickness of 2 mm, a hollow diameter of 20 mm and an outside diameter of 24 mm.

Hollow center IV: A hollow center IV was prepared as generally described in the preparation of the hollow center I, with the exception that a thermoplastic polyester elastomer available from Dainippon Ink & Chemicals, Inc. as Grilux EH 700 was employed instead of the thermoplastic polyacethal polymer resin. The resulting hollow center has a wall thickness of 1 mm, a hollow diameter of 20 mm and an outside diameter of 22 mm.

Example 1

Figure 3:
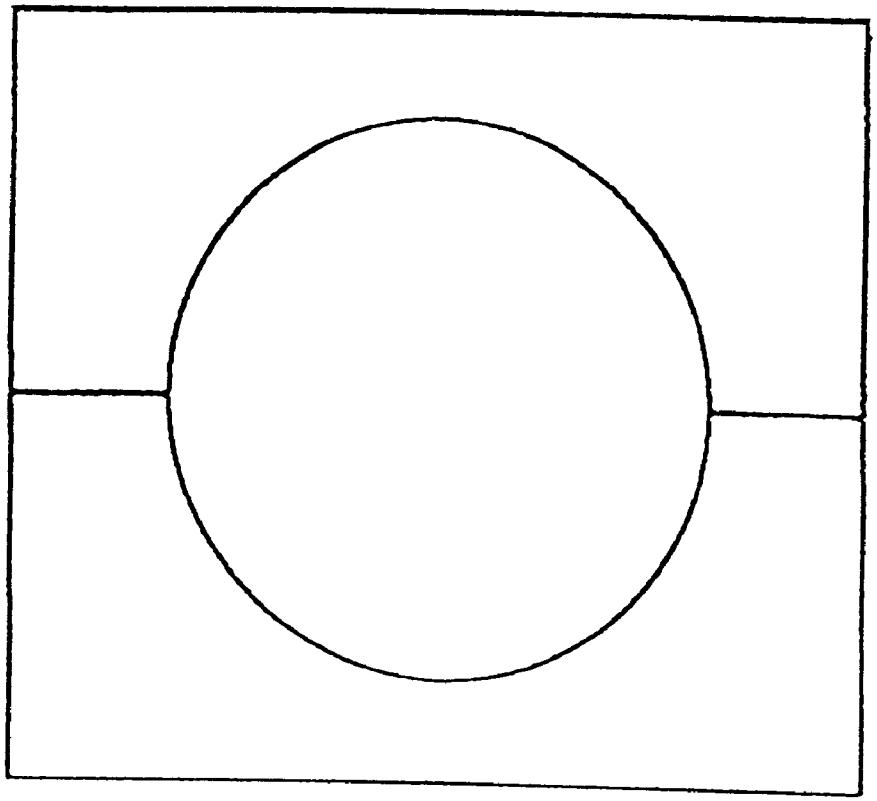
FIG. 3 is a schematic cross-section of the mold for vulcanizing a core.

The ingredients shown in Table 1 as A were mixed to form a rubber composition A. The rubber composition A was semi-vulcanized at 165° C. for 2 minutes in a mold for semi-spherical core as shown in FIG. 2 in which a spherical convex core mold having a given shape was inserted, to form two semi-vulcanized half spherical shells. Then, the convex core mold was removed and the hollow center I was encapsulated instead with two half spherical shells in a mold as shown in FIG. 3, followed by vulcanizing at 165° C. for 20 minutes to form a hollow core having a diameter of 38.4 mm. In Table 1, the numbers all show parts by weight.

Preparation of Cover

The hollow core obtained above was then covered with a cover composition shown in Table 2 by injection-molding to form a cover layer, and then a paint was applied to obtain a large size hollow golf ball having a diameter of 42.7 mm.

TABLE 1

| Ingredients | A | B |
|---|---|---|
| BR-11*1 | 100 | 100 |
| Zinc acrylate | 37 | 37 |
| zinc oxide | 5 | 5 |
| Barium sulfate | 56.8 | 18.6 |
| Antioxidant*2 | 0.5 | 0.5 |
| Dicumyl peroxide | 1.0 | 1.0 |

*1Cis-1,4-polybutadiene having a cis content of 96%, available from Japan Synthetic Rubber Co., Ltd.
*2An antioxidant available from Yoshitomi Pharmaceutical Industries, Ltd.

TABLE 2

| Ingredients | Parts by weight |
|---|---|
| Hi-milan #1805*3 | 50 |
| Hi-milan #1706*4 | 50 |
| Titanium dioxide | 2 |

*3An ionomer resin available from Mitsui Polychemical Co., Ltd.
*4An ionomer resin available from Mitsui Polychemical Co., Ltd.

The hollow golf ball of Example 1 was subjected to the evaluations of distribution of diameter of hollow portion, moment of inertia, impact strength, flight performance by a driver (No. 1 wood club), shot feel at the time of hitting and durability. The results of the evaluations are shown in Table 3.

The methods of the evaluations are as follow.

(1) Distribution of Diameter of Hollow Portion

A hollow golf ball was cut into half and diameters of aa', bb' and cc' which are shows in FIG. 1 were measured. A difference between the longest diameter and the shortest diameter is shown in Table 3 as distribution of diameter of hollow portion.

(2) Moment of Inertia

Moment of inertia was determined at a seam line and at a line crossing at right angle with the seam line by a measuring device available from INERTIA DYNAMICS CO. in as Model Number 005-002.

(3) Impact Strength

A driver is equipped with a swing robot available from True Temper Co. in U.S.A. and an acceleration meter is attached to the rear portion of a club head. An acceleration developing at a reverse direction to a moving direction of the head is determined thereby. The maximum value of the resulting acceleration is converted into force and expressed as an index making 100 the value of a golf ball without hollow.

(4) Flight Distance (Carry)

A driver is equipped with a swing robot available from True Temper Co. in U.S.A. and hit a golf ball at a head speed of 45 m/sec. A distance from the hitting point to a point where the ball reaches on the ground for the first time is determined as carry.

(5) Shot Feel at the Time of Hitting

Ten professional golfers actually hit golf balls with a driver and evaluate with their feel.

Criteria

Very good: 8 or more persons think good shot feel.

Good: 5 to 7 persons think good shot feel.

Fairly good: 2 to 4 persons think good shot feel.

Bad: Less than two persons think good shot feel.

(6) Durability

A driver is equipped with a swing robot available from True Temper Co. and a golf ball is hit by the driver at a head speed of 45 m/sec and collided with an impact wall. The criteria are as follow.

Criteria

Good: No cracks are present after 50 times collisions.

Poor: Cracks are present before 50 times collisions.

Examples 2 to 4

Hollow golf balls were obtained as generally explained in Examples, with the exception that each of the hollow centers II, III and IV was instead of the hollow center I. The same evaluations were conducted on the golf ball and the results are shown in Table 3.

Comparative Example 1

The ingredients shown in Table 1 as A were mixed to form a rubber composition A. The rubber composition A was semi-vulcanized at 165° C. for 2 minutes in a mold for semi-spherical core as shown in FIG. 2 in which a spherical convex core mold having a given shape was inserted, to form two semi-vulcanized half spherical shells. Then, the resulting two half spherical shells were adhered with each other while the hollow center was not included therein, and then vulcanized at 165° C. for 20 minutes in a mold as shown in FIG. 3 having a given shape to form a hollow core having a diameter of 38.4 mm and a hollow diameter of 20 mm.

The hollow core obtained above was then covered with a cover composition shown in Table 2 by injection-molding to form a cover layer, and then a paint was applied to obtain a large size hollow golf ball having a diameter of 42.7 mm. The same evaluations were conducted on the golf ball and the results are shown in Table 3.

Comparative Example 2

A hollow golf ball was prepared as generally described in Example 1, with the exception that the hollow center I was not employed and the hollow core was preliminary vulcanized at 165° C. for 7 minutes. The same evaluations were conducted on the golf ball and the results are shown in Table 3.

Comparative Example 3

A hollow golf ball was prepared as generally described in Comparative Example 1, with the exception that the two half spherical shells were preliminary vulcanized at 165° C. for 20 minutes and then preliminary adhered by coating their adhereing area with an acetone solution of the core rubber composition, followed by vulcanizing at 165° C. for 20 minutes. The same evaluations were conducted on the golf ball and the results are shown in Table 3.

Comparative Example 4

A solid golf ball without hollow was prepared as generally described in Example 1, with the exception that the hollow center I was not employed and the rubber composition B shown in Table 1 was employed instead of the rubber composition A and molded in a mold as shown in FIG. 3 to form a solid center without hollow. In the process of molding the core, the core mold was not employed in this Comparative Example and vulcanized at 165° C. for 20 minutes. The same evaluations were conducted on the golf ball and the results are shown in Table 3.

TABLE 3

| | Examples | | | | Comparative Examples | | | |
|---|---|---|---|---|---|---|---|---|
| | 1 | 2 | 3 | 4 | 1 | 2 | 3 | 4 |
| Hollow center | I | II | III | IV | — | — | — | — |
| Rubber composition | A | A | A | A | A | A | A | B |
| Diameter of hollow (mm) | 20 | 20 | 20 | 20 | 20 | 20 | 20 | |
| Distribution of hollow portion (mm) | 0.8 | 0.7 | 1.0 | 0.7 | 10.2 | 3.4 | 1.6 | — |
| Moment of inertia ($gcm^2$) | 86.70 | 86.83 | 86.69 | 86.84 | * | 86.75 | 86.75 | 80.94 |
| Index of impact strength | 92 | 92 | 92 | 92 | * | 92 | 92 | 100 |
| Flight distance (yards) | 232.5 | 233.2 | 232.3 | 232.9 | * | 232.0 | Cracks | 233.5 |
| Shot feel when hitting | Very good | Very good | Very good | Very good | | Very good | Cracks | Fairy good |
| Durability | Good | Good | Good | Good | * | Poor | Poor | Good |

* The uniformity of the golf ball was very poor and no measurement was conducted.

As is apparent from the above results, the hollow golf balls obtained by the present invention have complete spherical cavities in the center and show excellent durability. The golf balls of Comparative Examples do not have enough sphericity and show poor durability. The golf balls of the present invention exhibit superior properties in impact strength and shot feel to the golf balls of Comparative Examples.

What is claimed is:

1. A hollow golf ball comprising:

(a) a hollow center formed from a material selected from the group consisting of rubber, thermoplastic resin and a mixture thereof, the hollow center having a hollow portion with a diameter of 5 to 30 mm;

(b) at least one core rubber layer, formed on said hollow center, the core rubber layer being obtained by vulcanizing a rubber composition which comprises a base rubber, a metal salt of an unsaturated carboxylic acid, an organic peroxide and filler; and (c) a cover formed on said core rubber layer.

2. The hollow golf ball according to claim 1, wherein the rubber for the hollow center is formed from a rubber composition comprising a natural rubber, synthetic rubber, or both; sulfur, a metal salt of an unsaturated carboxylic acid, or both; organic peroxide; and filler.

3. The hollow golf ball according to claim 1, wherein the thermoplastic resin for the hollow center melts at a temperature of not less than 150° C.

4. The hollow golf ball according to claim 1, wherein the cover is formed from ionomer resin or balata.

5. The hollow golf ball according to claim 1, wherein the hollow portion contains air or nitrogen gas under a pressure of one to two atmospheres.

6. The hollow golf ball according to claim 1, wherein the thermoplastic resin for the hollow center melts at a temperature of not less than 170° C. and not more than 230° C.

7. The hollow golf ball according to claim 1, wherein the hollow portion has a diameter of 10 to 25 mm.

8. The hollow golf ball according to claim 1, wherein the hollow center has a wall thickness of 0.1 to 12.5 mm.

9. The hollow golf ball according to claim 1, wherein the hollow center has a wall thickness of 1.0 to 6.0 mm.

10. The hollow golf ball according to claim 1, wherein the hollow center has a diameter of 35 to 41 mm.

11. The hollow golf ball according to claim 1, wherein the hollow center has a diameter of 36 to 39 mm.

12. The hollow golf ball according to claim 1, wherein the metal salt of an unsaturated carboxylic acid is a monovalent or divalent metal salt of an alpha, beta-unsaturated carboxylic acid having 3 to 8 carbon atoms present in an amount of 25 to 55 parts by weight, based on 100 parts by weight of the base rubber.

13. The hollow golf ball according to claim 12, wherein the metal salt is zinc acrylate.

* * * * *